United States Patent [19]

Fletcher

[11] 4,010,362

[45] Mar. 1, 1977

[54] LUMINAIRE SHIELD DEVICE

[75] Inventor: Thomas A. Fletcher, Dana, N.C.

[73] Assignee: General Electric Company, New York, N.Y.

[22] Filed: Dec. 4, 1975

[21] Appl. No.: 637,757

[52] U.S. Cl. ..... 240/147

[51] Int. Cl.[2] ..... F21V 17/00

[58] Field of Search ..... 240/51.11 R, 25, 147

[56] References Cited

UNITED STATES PATENTS

| | | | |
|---|---|---|---|
| 2,291,495 | 7/1942 | Beals | 240/51.11 R |
| 3,065,339 | 11/1962 | Fahey | 240/25 |
| 3,071,683 | 1/1963 | Queale | 240/25 |
| 3,387,866 | 6/1968 | Baldwin | 240/147 UX |

*Primary Examiner*—Donald A. Griffin
*Attorney, Agent, or Firm*—Sidney Greenberg

[57] ABSTRACT

Shield device for outdoor luminaires to prevent entry of birds into the interior. The device comprises a generally U-shaped stiff plastic sheet which is permanently attached to the luminaire mounting device and substantially covers an opening at the rear of the luminaire adjacent its pipe support. The shield device is moved into operative position by closing the hinged bottom door of the luminaire.

6 Claims, 5 Drawing Figures

LUMINAIRE SHIELD DEVICE

The present invention relates to luminaires, and more particularly to a bird shield device for outdoor luminaires.

It is an object of the invention to provide an improved shield device for outdoor luminaires for preventing entry of birds and other small animals into the interior of the luminaire.

It is another object of the invention to provide a bird shield device of the above type which is simple in form, is readily made and installed, is permanently attached to the luminaire, is adapted for use with various type of luminaires, and is self-adjusting to various sizes of pipe supports on which the luminaire is mounted.

Other objects and advantages will become apparent from the following description and the appended claims.

With the above objects in view, the present invention in one of its aspects relates to a luminaire comprising, in combination, a housing having an open end defining an axis and adapted to freely receive along said axis an elongated support member on which the luminaire is to be mounted, bearing means on the housing for engaging the top of the elongated support member, a movable clamp in the housing extending transverse the axis for engaging the bottom of the elongated support member, a pair of adjusting bolts on the housing respectively adjustably engaging the movable clamp on opposite sides of the axis, and a shield member comprising a generally U-shaped bendable sheet arranged in the housing for substantially covering the opening between the housing and the elongated support member, the sheet being formed with a main shield portion and a pair of apertured legs extending therefrom, the sheet arranged in the housing with its main shield portion extending below and transverse the axis and its legs respectively inserted on the pair of adjusting bolts above the movable clamp.

The invention will be better understood from the following description taken in conjunction with the accompanying drawing, in which.

Figure 1:
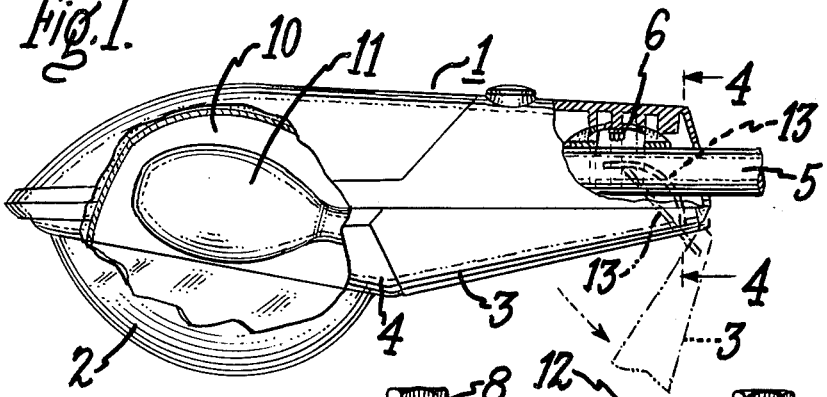
FIG. 1 is a side view in elevation, partly broken away, of a mounted street lighting luminaire in which the shield device of the invention may be embodied.

Referring now to the drawing, and particularly to FIG. 1, there is shown a street lighting luminaire comprising an upper housing 1 in which is located reflector 10 and lamp 11 and which is closed on its bottom at the front by refractor 2 and at the rear by door 3. In the particular form of the luminaire illustrated, refractor 2 is mounted in frame 4 hingedly connected at its rear portion to housing 1 by means not shown, and rear bottom door 3 is hingedly connected to the housing 1 (see also FIG. 3), so as to be swingable downwardly to the position indicated by interrupted lines in FIG. 1. Frame 4 and bottom door 3 are each releasably attached to housing 1 by suitable latch means (not shown).

Housing 1 has an opening at its rear end for freely receiving along its longitudinal axis an elongated support member 5, such as a tubular bracket or pipe, which may extend generally horizontally from a pole or other vertical support, and on which the luminaire is mounted by means of slipfitter 6. The latter device provides for adjustment of luminaire housing 1 about its aforementioned longitudinal axis and about a transverse axis, as more fully disclosed in Baldwin U.S. Pat. No. 3,387,866, assigned to the same assignee as the present invention. As there described, the slipfitter includes a movable bearing 12 (see FIG. 3) having a curved underside which comes into contact with the upper curved surface of pipe bracket 5. Yoke or clamp member 7 extending transversely of the longitudinal housing axis contacts the curved lower surface of pipe bracket 5 and is held in clamping engagement therewith by spaced adjusting bolts 8, 9 which are arranged on opposite sides of the housing axis, passing through housing bosses 1*a*, 1*b*, and threadably engaging clamp member 7 at opposite ends (see FIG. 4). Such adjustability permits the accommodation of pipe brackets of different diameters.

Figure 2:
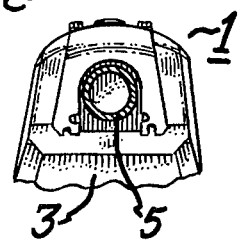
FIG. 2 is a rear view in elevation of the FIG. 1 luminaire.

With the luminaire mounted in installed position on the bracket 5, a substantial opening is left between the pipe bracket and the adjacent housing portion, as seen in the rear view of FIG. 2, through which birds may enter the interior of the housing and interfere with the proper operation of the luminaire. In accordance with the present invention, a simple self-adjusting bird shield is arranged in the luminaire housing to prevent such entry of birds, while being permanently attached to the slipfitter without the necessity for any additional mounting hardware.

Figure 4:
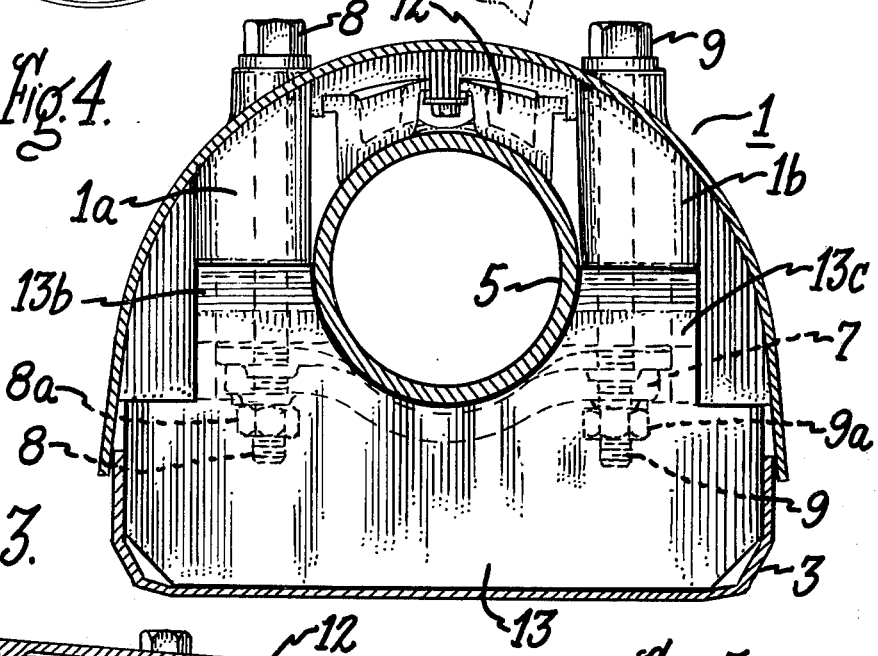
FIG. 4 is a cross-sectional view of the luminaire taken along the line 4—4 of FIG. 1.
Figure 3:
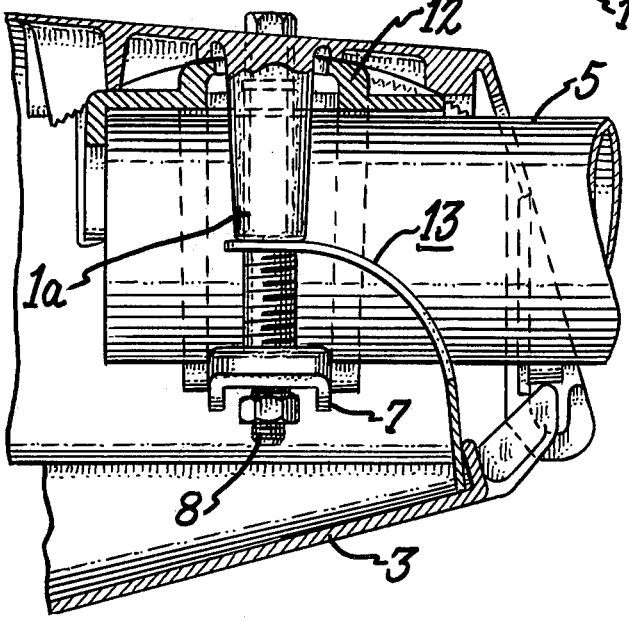
FIG. 3 is an enlarged detail view, partly in section, of the rear portion of the luminaire showing the shield device in installed operative position.
Figure 5:
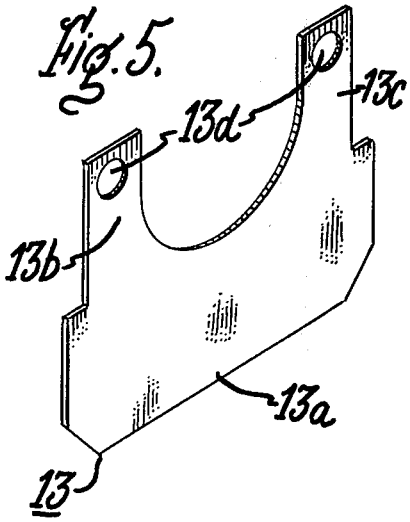
FIG. 5 is a perspective view of the shield member.

As seen in FIG. 5, the bird shield is constituted by a generally U-shaped sheet member 13 which is relatively stiff and bendable, and may be made, for example, of a suitable plastic material, such as polyethylene or polypropylene. Sheet member 13 is formed of a main shield portion 13*a* and a pair of legs 13*b*, 13*c* extending therefrom. Each leg of sheet member 13 is formed with an aperture 13*d* of a size sufficient to receive adjusting bolts 8, 9 respectively therethrough. As seen in FIGS. 3 and 4, shield 13 is installed within housing 1 with apertured legs 13*b*, 13*c* inserted on bolts 8, 9 and main shield portion 13*a* extending downwardly and rearwardly therefrom. In the installing procedure shield 13 is fitted onto bolts 8, 9 before clamp member 7 is assembled on the bolts, and the clamp member is then threadably attached to the bolts. Lower bolt heads 8*a*,9*a* may then be forcefitted on the lower ends of bolts 8, 9, or may be dispensed with entirely if desired, since bolts may be adjusted by means of the integral bolt heads at the top of the bolts.

When shield 13 is thus assembled, and with hinged door 3 in the lowered open position, the shield is in a generally straight, unbent condition, as seen by the interrupted lines in FIG. 1. When lower door 3 is moved up into closed position, it automatically moves and bends shield 13 into operative installed position to close the open areas below and around the mounting pipe 5, as seen in FIGS. 3 AND 4. In this position, the apertured portions of legs 13*b*, 13*c* abut against the bottom of housing bosses 1*a*, 1*b*.

Shield member 13 is preferably so dimensioned that its main shield portion 13*a* is sufficiently deep to close the opening below mounting pipes of the smallest diameter to be used. When larger diameter support pipes are employed, shield member 13 simply bends or deforms to a somewhat greater degree to accommodate the larger pipes. As seen in FIG. 4, the width of main shield portion is substantially co-extensive with the width of bottom door 3.

While the invention has been described and shown in connection with a luminaire which has a separate hinged rear door, it will be understood that it may be employed in luminaires in which the housing bottom is closed by a singled hinged door in which the refractor is mounted.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A luminaire comprising, in combination, a housing having an open end defining an axis and adapted to freely receive along said axis an elongated support member on which the luminaire is to be mounted, bearing means on said housing for engaging the top of the elongated support member, a movable clamp in said housing extending transverse said axis for engaging the bottom of the elongated support member, a pair of adjusting bolts on said housing respectively adjustably engaging said movable clamp on opposite sides of said axis, and a shield member comprising a generally U-shaped bendable sheet arranged in said housing for substantially covering the opening between said housing and the elongated support member, said sheet formed with a main sheild portion and a pair of apertured legs extending therefrom, said sheet arranged in said housing with its main shield portion extending below and transverse said axis and its legs respectively inserted on said pair of adjusting bolts above said movable clamp.

2. A luminaire as defined in claim 1, said housing having a bottom opening, said bottom opening closed by a bottom door hingedly connected to said housing, said shield member having a bottom edge resting on said bottom door and being movable into bended operative position by said bottom door when the latter is moved to closed position.

3. A luminaire as defined in claim 2, said housing formed with a pair of depending bosses to which said adjusting bolts respectively pass, said apertured legs of said shield member abutting said bosses in said operative position.

4. A luminaire as defined in claim 3, said shield member comprising a sheet of stiff plastic material.

5. A luminaire as defined in claim 3, said bottom door having opposite side walls defining the width thereof, said main shield portion extending across substantially the entire width of said bottom door.

6. A luminaire as defined in claim 2, said open end being at the rear of said housing, said shield member in operative position being curved rearwardly and downwardly.

* * * * *